US005697874A

United States Patent [19]

Abelbeck

[11] Patent Number: 5,697,874

[45] Date of Patent: Dec. 16, 1997

[54] ABDOMINAL EXERCISER

[76] Inventor: Kevin Abelbeck, 1220 Venice Blvd. #205, Venice, Calif. 90291

[21] Appl. No.: 662,776

[22] Filed: Jun. 10, 1996

[51] Int. Cl.[6] ..... A63B 23/02

[52] U.S. Cl. ..... 482/140; 482/132; 482/142

[58] Field of Search ..... 482/10, 92, 95, 482/96, 121–123, 130–137, 139, 140, 142, 148, 908

[56] References Cited

U.S. PATENT DOCUMENTS 5,492,520 2/1996 Brown .
5,591,111 1/1997 Wang et al. ..... 482/140

OTHER PUBLICATIONS

Paper The Basic Kinematics of the Human Spine; White, A.A., and Panjabi, M.M. Mar. 1978.
Brochure Fitness Quest (Abs of Steel), AB Sculptor and Keys Fitness Products (ABEX AbEx.)
Paper Low Back Pain and Subsequent Cardiovascular Mortality; Heliovaara, et. al. Sep. 1995.
Paper Modeling a Chiropractor:Population Ratio; Grier and Lepnurm Sep. 1995.
Paper Unconventional Medicine in the United States; Eisenberg, et. al. Jan. 1993.

*Primary Examiner*—Richard J. Apley
*Assistant Examiner*—Jeanne M. Clark

[57] ABSTRACT

An abdominal exercise device is disclosed. The invention includes a pair of arm portions for the user to grasp, a head rest and support attached thereto, the support being attached to the arm portions, an extension portion extending from each arm portion and a curved radius on the other end thereof. The curved radius being received by a segmented track, the proximal end of the track being fixed to the extension portions such that when a person lies face up between the extension portions with their head on the head rest and pulls down on the arm portions, contracting the abdominal muscles and rolling the curved radius along the track picking up same, the abdominal muscles are worked and the instantaneous center of rotation of the articulating vertebrae are in proper alignment with the instantaneous rotation of the device. This guides the body in a proper sit up movement working the abdominal muscles while the head and neck are constantly supported by the head rest. A pelvis support can be fixed to the distal end of each of the tracks thereby offering and maintaining proper placement of the body to the machine, protecting the tail bone from injury from a hard floor and placing the pelvis in slight posterior rotation, reducing lower back stress during the movement.

24 Claims, 5 Drawing Sheets

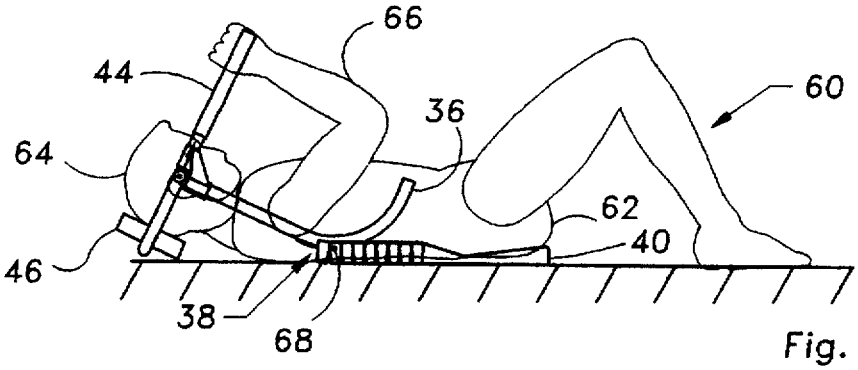
Fig. 5A
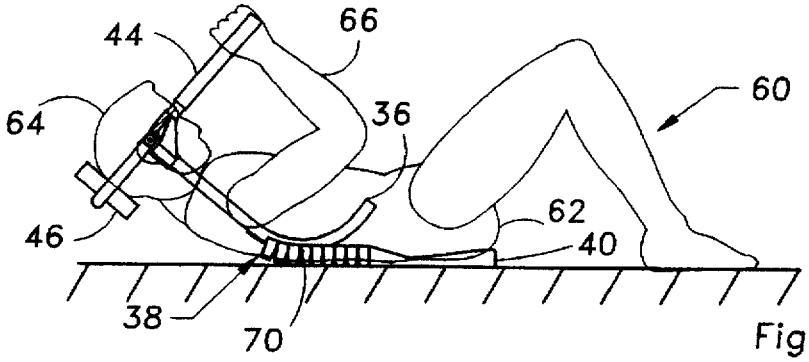
Fig. 5B
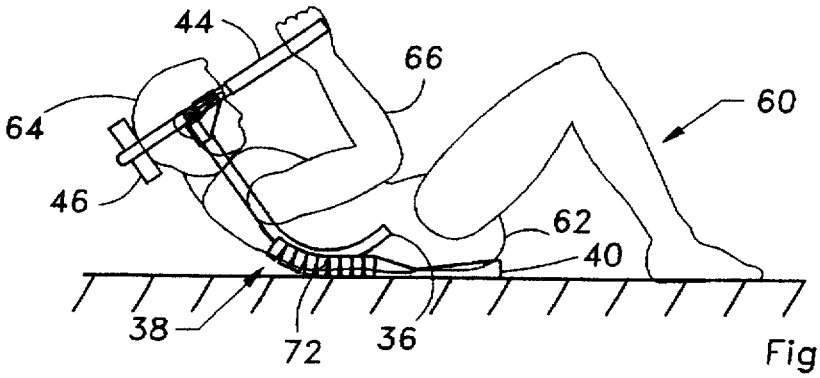
Fig. 5C
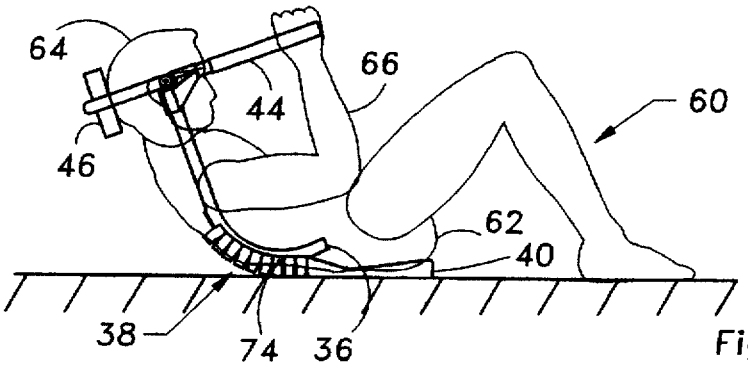
Fig. 5D
Fig. 5

ABDOMINAL EXERCISER

BACKGROUND OF THE INVENTION

1. Field of the Invention

The invention herein relates to an exercise device, and more particularly to an exercise device for working and strengthening the abdominal muscles.

2. Overview of Prior Art

One of the most effective exercises for working and therefore strengthening the abdominal or anterior trunk muscles is the common "sit up". A variety of exercise devices have been devised in order to try to mimic that movement, but to limited avail. Most institutional exercise devices utilize a single pivotal axis for trunk flexion. This pivot is traditionally aligned near the head of the femur or near the land mark of the greater trochanter, resulting in the transverse axis of the hip joint. The result is isolated movement of the hip flexor muscles and not the abdominal muscles. In this case the abdominal muscles are only called upon to stabilize the trunk. Movement must take place in the vertebrae in order for flexion to occur in the abdominal muscles. A sit up motion can allow this proper trunk flexion but it is not mandated because without a device to guide the motion, flexion can occur from the hip, the vertebrae or optimally a combination of the two.

A simple device that caused a forward translating center of rotation was disclosed by Brown in U.S. Pat. No. 5,492,520 in that the radiused rocker portions roll forward as the user rocks forward through a sit up movement. A pad is provided which is intended to support the user's head during the movement and a pair of arm rest portions are intended to be used to push against to apply the force to rock the device upward. In this device, the translating center of rotation follows the point of contact of the rocker and the floor. The body's rotation through the lumbar and thoracic vertebrae is raised to approximately 1 ¼ to 1 ½ inches above the floor. Thus the body's are of rotation is not aligned with the machine's and the body does not move in conjunction therewith, discounting the functionality of the device by not adequately supporting the head nor guiding the body in a proper movement of a sit up.

Subsequent versions of the above mentioned art include similar devices with the addition of a foot to raise the rocker off of the floor. This does raise the axis of rotation but removes the translating aspect of the same. The purpose of the device is to guide the body in the proper movement and to do so the device must follow the body's proper function as closely as possible. If the horizontal translation of the rotating axis can be greater than 10 inches and the single pivot is positioned in the midpoint thereof, then the misalignment will be five inches at some point during every repetition. With a device produced in accordance with the Brown patent the misalignment will be constantly at least one and one quarter inches. Both methods have their shortcomings but the use of the foot makes a functionally mediocre product virtually nonfunctional for its intended purpose.

Another example incorporating the single pivot point is the "Abs of Steel" machine by *Fitness Quest*. In this a single pivot point is used that is supported by a plastic "pad" which is positioned under the small of the back (the lumbar curve). Though having a method of locating the machine to the body can be beneficial, accentuating the lumbar curve is potentially detrimental in that increasing the lumbar curve during trunk flexion increases lower back strain. Optimally you would want to reduce the lumbar curve by tilting the pelvis posteriorly, just the opposite of this product.

SUMMARY OF THE INVENTION

The object of the disclosed invention is to provide a means of guiding the human body through trunk flexion by continuously supporting the head and neck. This is accomplished by providing the proper flexural range of motion and proper alignment of the forward translating axis of rotation. In addition a pelvis support is provided which supports the pelvis and protects the coccyx (tailbone) from potential injury by increasing the area of contact of the support under the pelvis. The pelvis support also functions in the disclosed invention by placing the pelvis in a slight posterior rotation thereby reducing lower back stress at the starting position of every repetition. The use of the pelvis pad has another function of locating the pelvis and properly positioning it with respect to the device which aids in attaining proper alignment of the translating axis of the body and the device.

BRIEF DESCRIPTION OF THE DRAWINGS

FIG. 5A–D is a four part sequential perspective in side view of the use of an abdominal exercise device produced in accordance with the preferred embodiment of the present invention.

DETAILED DESCRIPTION OF THE PREFERRED EMBODIMENT

It has been long accepted that the importance of physical exercise is paramount to health and longevity, especially in a predominantly sedentary society such as ours. The importance of properly exercising and therefore strengthening the muscles of the trunk are especially important in that they play a key roll in the stability and resistance to injury of the lower back. It is easy to understand the common occurrence of lower back pain in our "seated" and atrophied society. This problem is widespread as documented by the literature. One study reported that 76% of the general population have a history of back pain (*Spine,* 1995, 20(19) pp2109–11) and in another study 36.1% annually suffered from some musculoskeletal problem (*JMPT,* 1995, 19(7) pp464–70). A study in the *New England Journal of Medicine* (1993, 328(4) pp246–52) stated the highest frequency of use of unconventional therapy was used for back problems, domestically resulting in 153 million visits in 1990 and over $4.2 billion, not counting conventional medicine. As a counter measure and treatment to this problem strengthening of the abdominal muscles is accepted by both conventional and unconventional medicine. Unfortunately, the availability of properly designed equipment is less than common place, to say the least.

A truly functional resistance (strengthening) exercise device will usually fall into one of two categories. The first is one that the device conforms to the body's movement, in which the device provides additional degree(s) of freedom as compared to the body's movement, for a particular group of muscles being exercised. In many cases, especially with atrophied muscles, the body's movement needs to be learned or relearned, in this the second category, the device must guide the body through the proper movement. To accomplish this the device must support part or parts of the body and mimic the body's desired movement in order that the proper muscles are stressed. To support the body and mimic the movement, the center of rotation of the axis provided by the supportive bone structure must be always aligned to within a very close proximity.

Figure 1:
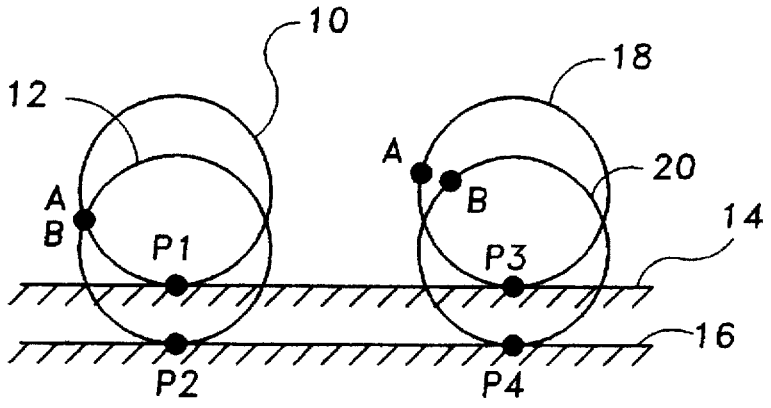
FIG. 1 is a schematic of a mathematical function of the novelty of the invention.

FIG. 1 shows two circles, the top circle 10 located just above the lower circle 12. The circles share a common point of A and B and both circles roll horizontally on the lines 14 and 16 respectively. In this case, the center of rotation of the top circle 10 is point P1 and the bottom circle is point P2. As the circle roll through 30 degrees of rotation, which is easily done in trunk flexion, the new circles 18 and 20 are established. Points A and B are easily determined to be no longer the same point. The center of rotation of the circles has translated forward (to the right) from P1 to P3 and from P2 to P4. If these paths were the same, the circles would overlap and all points would be consistent one with the other.

Figure 2:
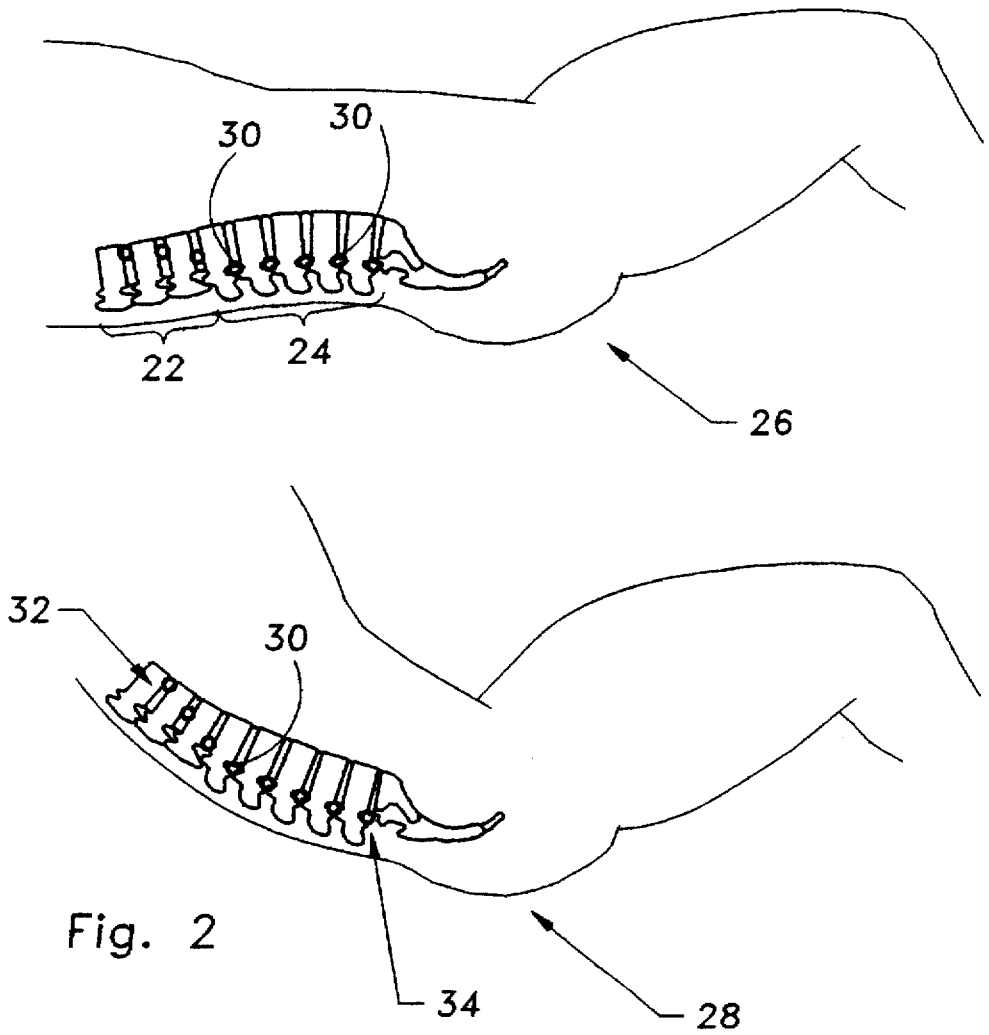
FIG. 2 is a side view of the sacrum, 5 lumbar and lower three thoracic vertebrae in their relative position in the human body and their movement as related to the disclosed invention.

Flexion of the primary trunk flexors, the rectus abdominis muscle and assisted by the external oblique muscles, provide a movement from the posterior portion of the anterior section of the rib cage, near the xiphoid process, to the pubic symphysis of the pelvis. The supportive structure which dictates the center of rotation are the lower thoracic 22 and lumbar 24 vertebrae, as shown in FIG. 2. Here the extended, or relaxed position 26 can be compared to the flexed position 28 The instantaneous center of rotation of the adjacent vertebrae are depicted by the circles 30 as based on the findings of White and Panjabi (*Spine,* 1978 3(1) pp12–29). It can be easily determined that the centers, of rotation 30 on a prone person are located between the vertebrae and therefore above the floor at all times. If we began flexion at the T10–T11 joint 32 and progressed through to the L5–S1 joint 34 the center of rotation would translate forward as the movement occurred.

The cited Brown prior art uses a rocker to roll on the floor, thus creating a forward translating instantaneous center of rotation but as displayed in FIG. 1, the center of rotation must be constantly aligned or the supportive structure of the machine (designated by point B) will not be consistent with the proper movement of the body (designated by point A). Other more traditional methods use a single pivot point for the machine. This is even less effective because the lateral translation of this instantaneous center can move more than 10 inches during a full range of motion. In both prior art cases a support for the head and neck would move greatly with respect to the body and therefore be nonfunctional outside of a very limited range of motion of the machine. Using only a limited range of motion of the machine makes the machine only marginally functional.

Figure 3:
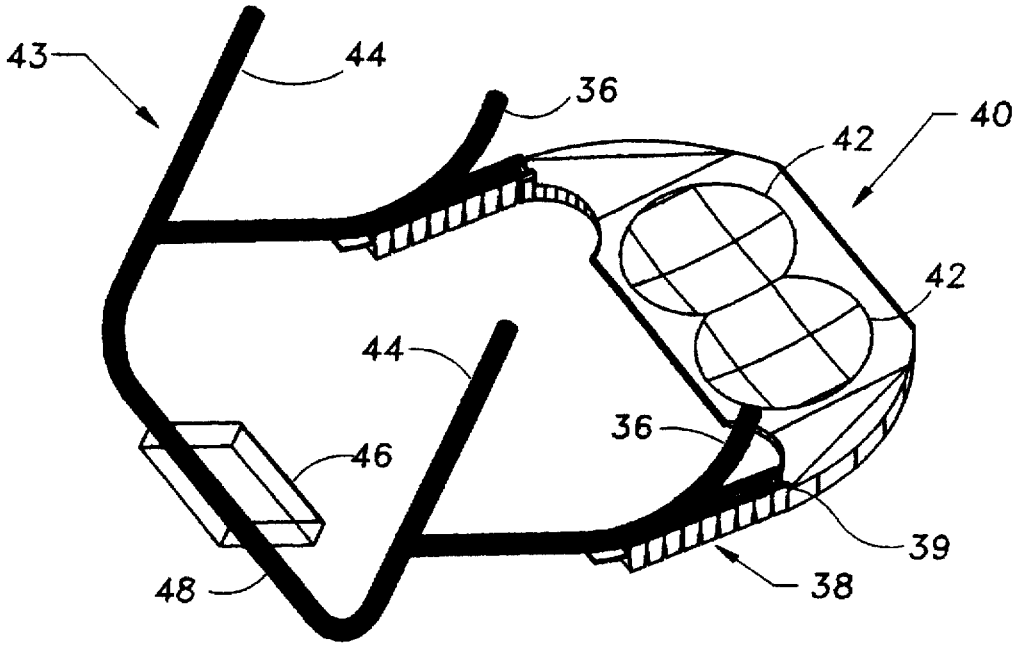
FIG. 3 is a prospective view of a abdominal exercise device produced in accordance with the preferred embodiment of the present invention.

FIG. 3 shows a novel device in that the rocker portion 36 is received by a segmented track 38 which includes a rocker support 39. This track 38 is shown to be continuous with a pelvis support 40 which includes concave portions 42 to comply with the curvature of the body due to the tuberosities of the ischium of the pelvis. An upper frame 43 includes a pair of arm 44 and a head rest portion 48. The pair of arms 44 are used to be grasped by the hands of the user and a head rest 46 is secured to the head support portion 48 in order to provide support for the head and neck of the user during movement of the exercise. The upper frame 43 can be formed from a single U-shaped member.

Figure 4:
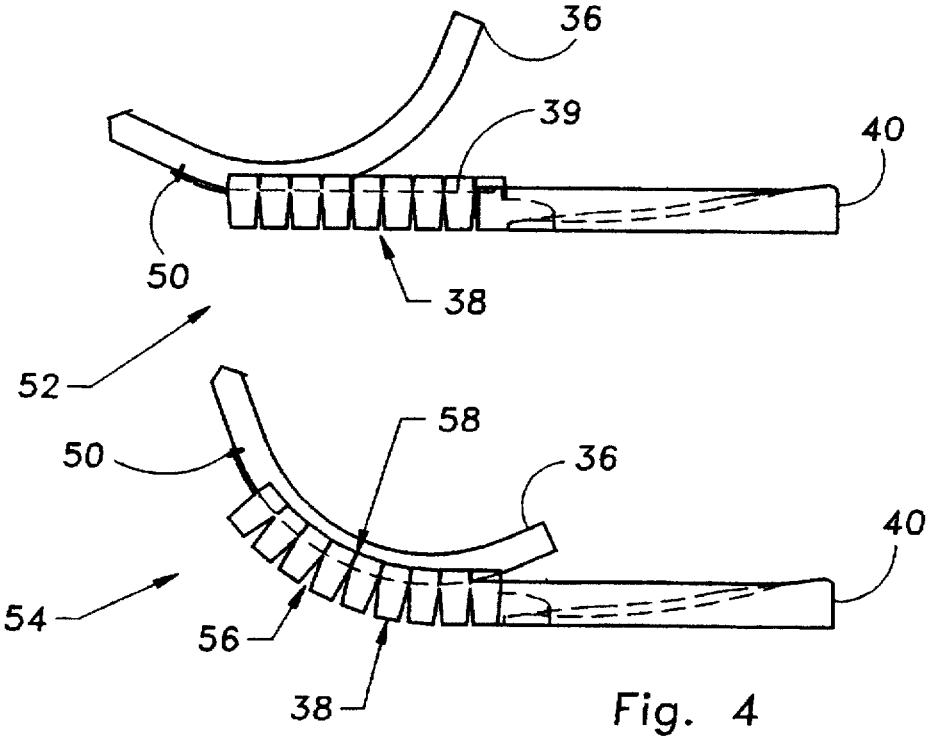
FIG. 4 is a partial side view of the support, track and rocker portions of an abdominal exercise device produced in accordance with the preferred embodiment of the present invention.

The detail for the movement of the invention is shown in FIG. 4 in that the rocker portion 36 is received by the track 38, on a rocker support 39 and secured thereto by the fastener 50. The fastener 50 can be either threaded fastener, rivet or adhesive, the track 38 is made out of thermoplastic material. The invention is shown in an extended or relaxed position 52 and a flexed position 54. Here it is shown that the gap between the adjacent segments increases on the lower portion 56 of the track 38 as it is used and the upper portion gap 58 decreases to the point of actual or near contact with the adjacent upper segment when the device is at full flexion. This is accomplished by the absence of material between the adjacent segments through the section of the track 38 at all places other than that of the desired location of the center of rotation of the adjacent segments of the track 38 This center of rotation is located above the bottom of the track 38 at the rocker support 49 that is positioned most advantageous to proper alignment with the instantaneous center of rotation of the adjacent vertebrae during trunk flexion, when the upper body of the user is positioned between the rocker portions 36 in a supine position. The center of rotation is approximately 1.25 inches above the bottom of the track and the rocker support is less than 0.25 inches thick, thus the center of rotation is elevated approximately 1.25–1.50 inches above a supportive surface when the device is being used for exercise.

The pelvis support 40 has a two fold function, as shown in FIG. 5. The pelvis support 40 locates the body to the device and prevents the rocker portions 36 from slipping as the device rocks up. Secondly, to reduce strain on the soft tissue supporting the lower spine, it is valuable to place the pelvis in a slightly flexed or posteriorly rotated position. The shape of the pelvis support 40 accomplishes this by placing the pelvis at approximately 15 degrees of posterior rotation. The pelvis support 40 is made out of thermoplastic material.

The progression of the movement from the starting position, shown in FIG. 5A to the flexed position, shown in FIG. 5D is displayed by the body 60 positioned in between the rocker portions 36 and the posterior portion 62 of the body 60 located on the pelvis support 40. The user's head 64 is supported by the head support 46 and the arm portions 44 are grasped by the hands of the user. The user pulls down on the arm portions 44 and flexes and shortens the abdominal muscles, thereby causing the device to rock up on the rocker portions 36 picking up the track 38 as the movement progresses. The vertical displacement of the center of gravity of the user and device results in work done. The angular position of the user's arm 66 with respect to the chest does not change nor does the hip position of the user, therefore the only movement is in the rotation of the vertebrae and the shortening of the abdominal muscles. The head 64 is fully supported at all times and a proper guide for the movement is provided by the invention due to the proper alignment of the forward translating instantaneous center of rotation in tune with the body. This translation is designated by the points 68, 70, 72 and 74 respectively at each stage of the movement.

Figure 6:
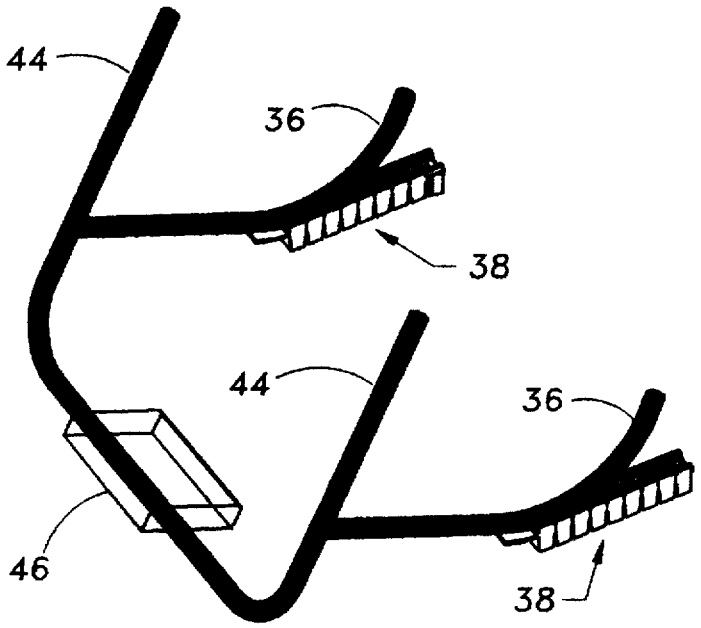
FIG. 6 is a prospective view of an abdominal exercise machine without a pelvis support and produced in accordance with the preferred embodiment of the present invention.

FIG. 6 shows the invention with the omission of the pelvis support. Here the arm portions 44, the head support 46 and the rocker portions 36 and their causal articulating movement of the segmented tracks 38 are the same as with the pelvis support as disclosed herein. The pelvis pad is greatly desirable but not a mandatory inclusion of the invention, in that the raised translating instantaneous center of rotation can still be achieved without the use of the pelvis support.

Figure 7:
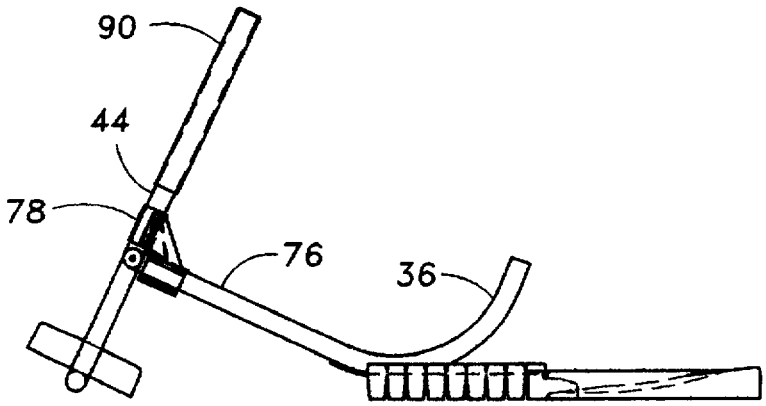
FIG. 7 is a side view of an alternative to the preferred embodiment of the present invention showing the aspects of a collapsible feature.

In most instances, reducing the storage space of the device is very desirable. Shown here in FIG. 7 is an alternative to the preferred embodiment in that the function is equivalent with the addition of the rocker portion 36 which is still continuous with the extension portion 76, but here it is pivotally mounted to the arm portion 44. An arm lock 78 is used to fix the arm portion 44 to the extension portion 76, [while the invention is in use thereby] making it rigid and thus preventing the arm portions 44 from rotating toward the rocker portions 36 when force is applied thereto, as happens when the invention is being used.

Figure 8:
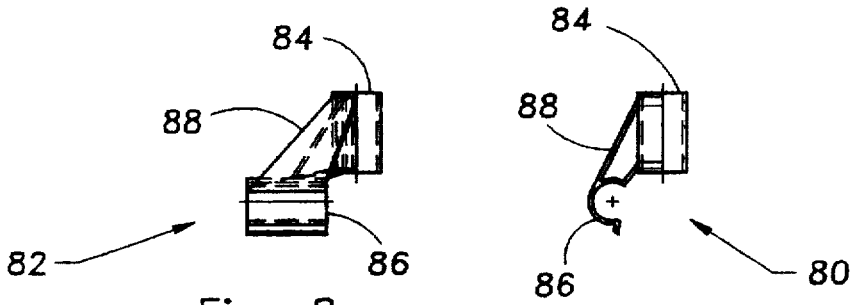
FIG. 8 is a front and side view of a lock used in conjunction with the collapsible feature of the alternative embodiment of the present invention.

The preferred embodiment of the arm lock is shown in more detail in FIG. 8. Here a front view 80 and a side view 82 of a left side lock are shown. The hollow cylinder 84 is received by the arm portion 44 (FIG. 7) and the clip 86 is used to snap fit over the center of the extension portion 76 (FIG. 7) tube, securing the same in a substantially orthogonal position. The gusset 88 offers compressive rigidity when the lock is in use, keeping the cylinder 84 and the clip 86 in their relative positions. The lock 78 is held onto the arm portion 44 of the invention by use of a grip 90 which is fixed onto the end of the arm portions 44, as shown in FIG. 7. This allows the lock 78 to rotate on the arm portion 44, thus to engage and disengage with its respective extension portion 76, but not able to be removed therefrom.

Figure 9:
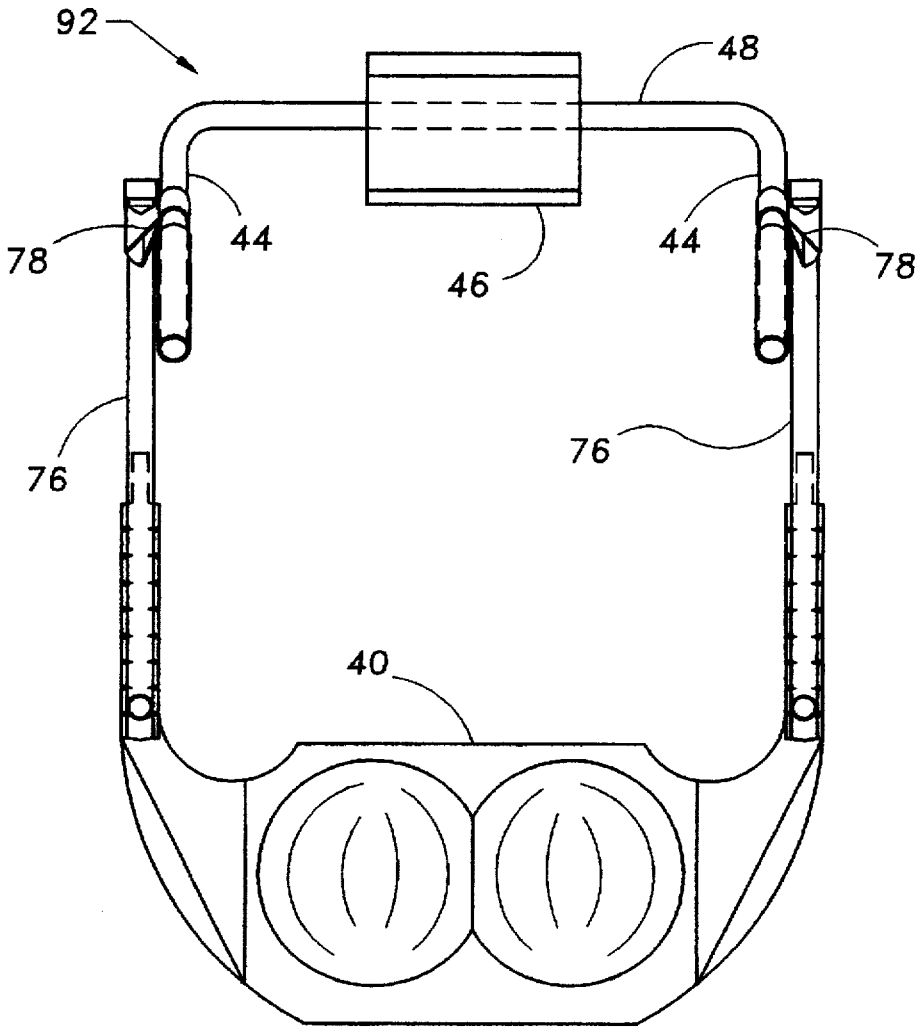
FIG. 9 is a plan view of an alternative to the preferred embodiment of the present invention showing the aspects of a collapsible feature.

On this design of the disclosed invention, it is preferable that the arm portions 44 be positioned on the inside or the outside of the extension portions 76 thus allowing rotation of one to another. FIG. 9 shows a top view of the preferred embodiment of the invention with the arm portions 44 being inside of the extension portions 76 and the locks 78 securing one to another. The pelvis support 40 and the head rest 46 are also shown in their respective positions. Here are shown the arm portions 44 and the head support 48 being preferably made in one "U-shaped" piece 92 and providing a means of attachment of the head rest 46 thereto. This attachment is commonly done by two or more holes in the head support 48 section of the U-shaped tube and a threaded fastener located through each hole and securing them to the head rest 46. The head rest 46 is typically comprised of a plywood backed foam pad with a vinyl covering. The arm portions 44, the head rest support 48, the rocker portions 36 and the extension portions 76 are comprised of round tubular material made from steel, aluminum, thermoplastic or composite fibers.

Figure 10:
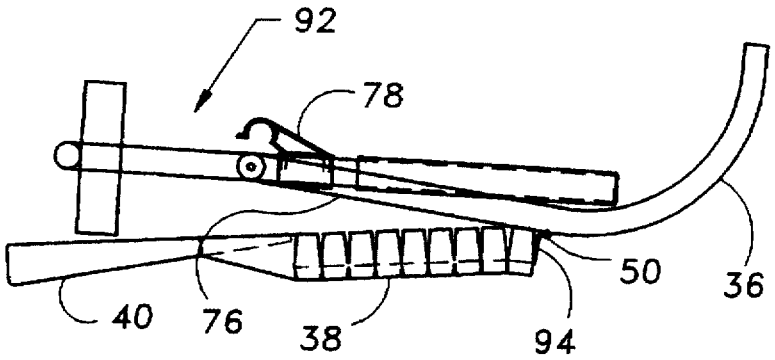
FIG. 10 is a side view in the collapsed position of an alternative to the preferred embodiment of the present invention showing the aspects of a collapsible feature.

When the locks 78 are disengaged from the extension tubes 76 the U-shaped portion 92 is able to rotate such that the arm portions 44 lie near and inside of the rocker portions 36. Here in FIG. 10 it is shown with the pelvis support 40 and the segmented tracks are attached to the extension portions 76 by the fastener 50. As shown here, a tab 94 is used to provide the attachment thereto. This tab 94 is constructed sufficient length and of a pliable material such that the flexural modulus is low enough that the tracks 38 can be bent back at least 180 degrees. The tab 94 will also possess sufficient resiliency so as to not damage the tab 94 after repeated flexing of the material. A mechanical hinge could also be used in place of the pliable material and the invention can also be folded up as shown here for easy storage. This also enables the invention to be preassembled in the factory and shipped in such a manner, thereby not requiting assembly by the consumer.

What is claimed is:

1. An exercise device comprising:

an upper frame including a pair of arm portions, at one end, disposed substantially parallel to each other and configured to allow a person to position their head therebetween and a head support portion, including a head rest, located at an opposite end to said arm portions and being substantially perpendicular to said arm portions;

a pair of rocker portions, each providing a smooth circular arc of a radius of approximately 6.5 inches;

a pair of extension portions, each with a first end mounted to a respective one of said arm portions and a second end supporting a respective one of said rocker portions;

a pair of segmented tracks, each track having an upper surface, a bottom surface, one end attached to a respective one of said extension portions and the other end free from attachment to a respective one of said rocker portions, the segments are configured to articulate one to another such that the center of rotation between the segments is above the bottom surface of the tracks and to substantially conform to the radius of said rocker portions, whereby a person can lie of their back on a supportive surface between said extension portions with their head on said head rest, grasp said arm portions and pull down, rolling said rocker portions on the tracks, picking the track segments up as the rocker portions roll forward, thereby creating a forward translating center of rotation, above the supportive surface, which is adapted to be substantially collinear with the center of rotation of the user's vertebrae.

2. The exercise device as described in claim 1, wherein said arm portions, said head rest portion, said rocker portions and said extension portions are comprised of round tubular material.

3. The exercise device as described in claim 2, wherein said tubular material is a material selected from the group consisting of steel, aluminum, thermoplastic and composite fibers.

4. The exercise device as described in claim 1, wherein said upper frame is comprised of a single U-shaped member wherein the two opens ends of the U-shaped member comprise the arm portions and the closed section comprises the head support portion.

5. The exercise device as described in claim 1, wherein said segmented tracks are attached to said extension portions by an attachment method selected from the group consisting of threaded fastening, riveting and adhesive bonding.

6. The exercise device as described in claim 1, wherein said tracks further include a rocker support on which each rocker portion is supported and said segments of said track articulate one with another such that the center of rotation is approximately 1.25 inches above said bottom surface of said track and said rocker support is less than 0.25 inches thick, thus elevating said forward translating center of rotation approximately 1.25–1.50 inches above the supportive surface when the device is being used.

7. The exercise device as described in claim 1, wherein said segmented track is comprised of a thermoplastic material.

8. An exercise device comprising:

an upper frame including a pair of arm portions, at one end, disposed substantially parallel to each other and configured to allow a person to position their head therebetween and a head support portion, including a head rest, located at an opposite end to said arm portions and being substantially perpendicular to said arm portions;

a pair of rocker portions, each providing a smooth circular arc of a radius of approximately 6.5 inches;

a pair of extension portions, each with a first end mounted to a respective one of said arm portions and a second end supporting a respective one of said rocker portions;

a pair of segmented tracks, each track having an upper surface, a bottom surface, a first end attached to a respective one of said extension portions and a second end free from attachment to a respective one of said rocker portions, the segments are configured to articulate one to another such that the center of rotation between the segments is above the bottom surface of the tracks and to substantially conform to the radius of said rocker portions;

a pelvis support disposed between said segmented tracks and continuous with the second end thereof, whereby a person can lie of their back on a supportive surface between said extension portions with their head on said head rest, grasp said arm portions and pull down, rolling said rocker portions on the tracks, picking the track segments up as the rocker portions roll forward, thereby creating a forward translating center of rotation, above the supportive surface, which is adapted to be substantially collinear with the center of rotation of the user's vertebrae.

9. The exercise device as described in claim 8, wherein said arm portions, said head rest portion, said rocker portions and said extension portions are comprised of round tubular material.

10. The exercise device as described in claim 9, wherein said tubular material is a material selected from the group consisting of steel, aluminum, thermoplastic and composite fibers.

11. The exercise device as described in claim 8, wherein said upper frame is comprised of a single U-shaped member wherein the two opens ends of the U-shaped member comprise the arm portions and the closed section comprises the head support portion.

12. The exercise device as described in claim 8, wherein said segmented tracks are attached to said extension portions by a fastener selected from the group consisting of threaded fasteners, rivets and adhesives.

13. The exercise device as described in claim 1, wherein said tracks further include a rocker support on which each rocker portion is supported and said segments of said track articulate one with another such that the center of rotation is approximately 1.25 inches above said bottom surface of said track and said rocker support is less than 0.25 inches thick, thus elevating said forward translating center of rotation approximately 1.25–1.50 inches above the supportive surface when the device is being used.

14. The exercise device as described in claim 8, wherein said segmented track and pelvis pad combination is comprised of a thermoplastic material.

15. The exercise device as described in claim 8, wherein said pelvis pad is configured to place a user's pelvis at approximately 15 degrees posterior rotation when the device is being used.

16. An exercise device comprising:

an upper frame including a pair of arm portions, at one end, disposed substantially parallel to each other and configured to allow a person to position their head therebetween and a head support portion, including a head rest, located at an opposite end to said arm portions and being substantially perpendicular to said arm portions;

a pair of rocker portions, each providing a smooth circular arc of a radius of approximately 6.5 inches;

a pair of extension portions, each with a first end mounted to a respective one of said arm portions and a second end supporting a respective one of said rocker portions;

at least one arm lock which is received by at least one of said arm portions and being configured to be detachably mounted to the extension portion, located adjacent thereto, thereby positioning said arm portion and said extension portion in a fixed position one to another;

a pair of segmented tracks, each track having an upper surface, a bottom surface, a first end attached to a respective one of said extension portions and a second end free from attachment to a respective one of said rocker portions, the segments are configured to articulate one to another such that the center of rotation between the segments is above the bottom surface of the tracks and to substantially conform to the radius of said rocker portions;

a pelvis support disposed between said segmented tracks and continuous with the second end thereof, whereby a person can lie of their back on a supportive surface between said extension portions with their head on said head rest, grasp said arm portions and pull down, rolling said rocker portions on the tracks, picking the track segments up as the rocker portions roll forward, thereby creating a forward translating center of rotation, above the supportive surface, which is adapted to be substantially collinear with the center of rotation of the user's vertebrae.

17. The exercise device as described in claim 16, wherein said arm portions, said head rest portion, said rocker portions and said extension portions are comprised of round tubular material.

18. The exercise device as described in claim 17, wherein said tubular material is a material selected from the group consisting of steel, aluminum, thermoplastic and composite fibers.

19. The exercise device as described in claim 16, wherein said upper frame is comprised of a single U-shaped portion wherein the two opens ends of the U-shaped member comprise the arm portions and the closed section comprises the head support portion.

20. The exercise device as described in claim 16, wherein said arm lock secures said arm portion and said extension portion located adjacent thereto at 90 degrees with respect to each other.

21. The exercise device as described in claim 16, wherein said segmented tracks are attached to said extension portions by a fastener selected from the group consisting of threaded fasteners, rivets and adhesives.

22. The exercise device as described in claim 1, wherein said tracks further include a rocker support on which each rocker portion is supported and said segments of said track articulate one with another such that the center of rotation is approximately 1.25 inches above said bottom surface of said track and said rocker support is less than 0.25 inches thick, thus elevating said forward translating center of rotation approximately 1.25–1.50 inches above the supportive surface when the device is being used.

23. The exercise device as described in claim 16, wherein said segmented track and pelvis pad combination is comprised of a thermoplastic material.

24. The exercise device as described in claim 16, wherein said pelvis pad is configured to place a user's pelvis at approximately 15 degrees posterior rotation when the device is being used.

* * * * *